US006062613A

United States Patent [19]

Jung et al.

[11] Patent Number: 6,062,613

[45] Date of Patent: May 16, 2000

[54] MOTOR VEHICLE DOOR LOCK OR THE LIKE

[75] Inventors: Oliver Jung, Wuppertal; Siegfried Reichmann, Wermelskirchen; Bernd Allefeld, Breckerfeld; Bernd Weyerstall, Wuppertal; Berthold Huessler, Ahaus; Bernd Huster, Muenchberg; Hansjuergen Linde, Coburg; Uwe Neumann, Bamberg; Heinrich Plett, Wermelskirchen; Stefan Schwitters, Remscheid, all of Germany

[73] Assignee: Robert Bosch GmbH, Stuttgart, Germany

[21] Appl. No.: 09/147,649

[22] PCT Filed: Jun. 19, 1997

[86] PCT No.: PCT/DE97/01260

§ 371 Date: Feb. 8, 1999

§ 102(e) Date: Feb. 8, 1999

[87] PCT Pub. No.: WO98/05840

PCT Pub. Date: Feb. 12, 1998

[30] Foreign Application Priority Data

Aug. 7, 1996 [DE] Germany ..... 196 31 869

[51] Int. Cl.[7] ..... E05C 3/06

[52] U.S. Cl. ..... 292/201; 292/216; 292/DIG. 23

[58] Field of Search ..... 292/201, 216, 292/DIG. 23, DIG. 42, DIG. 43, DIG. 67

[56] References Cited

U.S. PATENT DOCUMENTS

| | | | |
|---|---|---|---|
| 4,904,006 | 2/1990 | Hayakawa et al. | 292/336.3 |
| 4,948,183 | 8/1990 | Yamada | 292/199 |
| 5,180,198 | 1/1993 | Nakamura et al. | 292/201 |
| 5,474,338 | 12/1995 | Büscher | 292/201 |
| 5,667,260 | 9/1997 | Weyerstall | 292/201 |
| 5,934,717 | 8/1999 | Wirths et al. | 292/201 |
| 5,938,253 | 8/1999 | Szablewski et al. | 292/216 |

FOREIGN PATENT DOCUMENTS

| | | |
|---|---|---|
| 0 478 013 | 4/1992 | European Pat. Off. . |
| 195 00 509 | 2/1996 | Germany . |

*Primary Examiner*—Teri Pham

*Attorney, Agent, or Firm*—Nixon Peabody LLP; David S. Safran

[57] ABSTRACT

A motor vehicle door lock or the like including a housing with a detent pawl including a lock catch, a dynamic actuation linkage extending from an outside door handle and an inside door handle to the detent pawl, and a controller including a control disk with a plurality of peripherally located control cams, each of the control cams corresponding to a respective one of a plurality of functional positions including "locked", "unlocked", and optionally, "theft-proof" and "child-proof" positions. The lock also includes actuating elements in a control segment of the dynamic actuation linkage which is disengaged unless it is made engaged by coupling of the actuating elements by the action of one of the various control cams on the control disk. Thus, in the "locked" position, the dynamic actuation linkage to the outside door handle is disengaged so that the motor vehicle door cannot be opened by the outside door handle but the dynamic actuation linkage to the inside door handle is engaged so that the motor vehicle door can be opened by the inside door handle, and in the "unlocked" position, the dynamic actuation linkage is engaged to both the outside and inside door handles so that the motor vehicle door can be opened by both door handles. In the "theft-proof" position, the dynamic actuation linkage is disengaged to both the outside door handle and the inside handle so that the motor vehicle door cannot be opened by either door handle, and in the "child-proof" position, the dynamic actuation linkage to the inside door handle is disengaged so that the motor vehicle door cannot be opened by the inside door handle but the dynamic actuation linkage to the outside door handle is engaged so that the motor vehicle door can be opened by the outside door handle.

18 Claims, 3 Drawing Sheets

MOTOR VEHICLE DOOR LOCK OR THE LIKE

BACKGROUND OF THE INVENTION

1. Field of the Invention

The invention relates to a motor vehicle door locks including motor vehicle hood locks, tailgate locks, etc. including a dynamic actuation linkage extending from the outside and inside door handles to a detent pawl in which the dynamic actuation linkage may be made engaged or disengaged by a controller including a control disk with a plurality of peripherally located control cams, each of the control cams corresponding to a plurality of functional positions.

2. Description of the Related Art

Various types of control drives for motor vehicle door locks are known in the art, especially those for side doors of motor vehicles. One well known embodiment of a prior art control drive is disclosed in the published European Patent application EP-A-0 478 013 in which discloses a control drive including a control means with a control disk which overturns a corresponding actuating lever in a dynamic actuation linkage between an inside door handle or outside door handle and a detent pawl and thus, acts upon a lever mechanism such that the dynamic actuation linkage is either disengaged or engaged.

The German Patent DE-C-195 00 509 discloses another known motor vehicle door lock or the like including a control means with a control disk which has a single cam movably supported in a radial direction. The cam is rotatable to different angular positions by turning the control disk through a drive motor and the cam interacts with different levers or arms of the lever so that different operating positions, such as "locked", "unlocked", "theft-proof" and optionally, "child-proof" operating positions, can be attained by acting upon a relatively complicated lever mechanism. The complexity of the lever mechanism arises from the fact that the levers are arranged in an arc around the control disk and are used to attain the different functions by a way of slotted journal structures.

The aforementioned explanation clearly illustrates that in the prior art motor vehicle door locks, the construction of the control means is already largely simplified. However, as discussed above, the lever mechanisms that are used make the overall system of the motor vehicle door lock rather complicated.

SUMMARY OF THE INVENTION

Therefore, a primary object of the present invention is to provided an improved motor vehicle door lock or the like with a simplified structure and design without adversely affecting the cost or operating reliability.

The aforementioned object is achieved in a motor vehicle door lock or the like comprising a housing with a detent pawl including a lock catch, a dynamic actuation linkage extending from an outside door handle and an inside door handle to the detent pawl through which the detent pawl can be actuated to trigger the lock catch and open a motor vehicle door, and a controller including a control disk with a plurality of peripherally located control cams, each of the control cams corresponding to a plurality of functional positions including a "locked" position and an "unlocked" position. The positioning of the controller positions one of the control cams such that the control cam interacts within a control segment of the dynamic actuation linkage such that in the "locked" position, the dynamic actuation linkage to the outside door handle is disengaged so that the motor vehicle door cannot be opened by the outside door handle but the dynamic actuation linkage to the inside door handle is engaged so that the motor vehicle door can be opened by the inside door handle, and in the "unlocked" position, the dynamic actuation linkage is engaged to both the outside door handle and the inside handle so that the motor vehicle door can be opened by both outside and inside door handles. In other embodiments, the motor vehicle door lock also include a "theft-proof" position in which the dynamic actuation linkage path is disengaged to both the outside door handle and the inside handle so that the motor vehicle door cannot be opened by either door handles, and also a "child-proof" position in which the dynamic actuation linkage to the inside door handle is disengaged so that the motor vehicle door cannot be opened by the inside door handle but the dynamic actuation linkage path to the outside door handle is engaged so that the motor vehicle door can be opened by the outside door handle.

Unlike the prior art, the control disk of the present invention does not have a single control cam which can be moved into different angular positions and which interacts in the different angular positions with levers which are located in an arc around the control cam. Instead, a motor vehicle door lock in accordance with the present invention includes a plurality of control cams that correspond to the different operating positions and one of the control cams interact within a control segment of the dynamic linkage path to trigger the corresponding function associated with that functional position. By practicing the present invention, it is possible to drastically reduce the complexity ofthe prior art mechanical mechanisms that control the detent pawl without increasing the cost of the controller. In accordance with one embodiment of the present invention, the mechanical elements used in controlling the detent pawl should generally be centrally located in the control segment of the dynamic linkage path. The rotary motion of the control disk of the controller can be attained using the prior art methods but modified such that a control cam is not moved into a plurality of angular positions, but rather, the control disk with a plurality of control cams is moved into one functional position at a time.

The present invention reduces the complexity and the amount of mechanical couplings between the different control elements which can decrease reliability and cause breakdowns. While in the prior art designs, there had to be one lever for one function, by practicing the present invention, the plurality of levers in the prior art designs can be eliminated. The present invention is provided with actuating elements in the control segment of the dynamic actuation linkage which is disengaged unless it is made engaged by coupling the actuating elements through one of the various control cams on the control disk. In this manner, an unambiguous degree of coupling has been achieved through the present invention.

There are various different embodiments ofthe present invention and teachings disclosed which may be modified to develop additional embodiments of the present invention.

For instance, in another embodiment, the present invention may also provide additional motorized opening function which can be accomplished by the controller preferably including an electric drive motor. Therefore, integrating a motorized opening function in the motor vehicle door lock can be easily attained without significant additional costs or complexity.

According to another embodiment of the present invention, the triggering and actuating elements are made as tooth elements which are simply pressed against one another for coupling, i.e. for establishing a engaged dynamic actuation linkage in the respective functional position so that the rows of teeth engage one another and force can be transferred to the detent pawl. This is an extremely simple design which effectively implements the control cam technique of the control disk according to the teaching of this present invention.

In yet another embodiment ofthe present invention, the construction ofthe motor vehicle door lock or the like may include an emergency trigger means that can be integrated rather easily without significantly increasing the construction cost.

As an example only, the invention is explained in greater detail in the following using drawings which show one embodiment of the present invention.

DETAILED DESCRIPTION OF THE INVENTION

Figure 1:
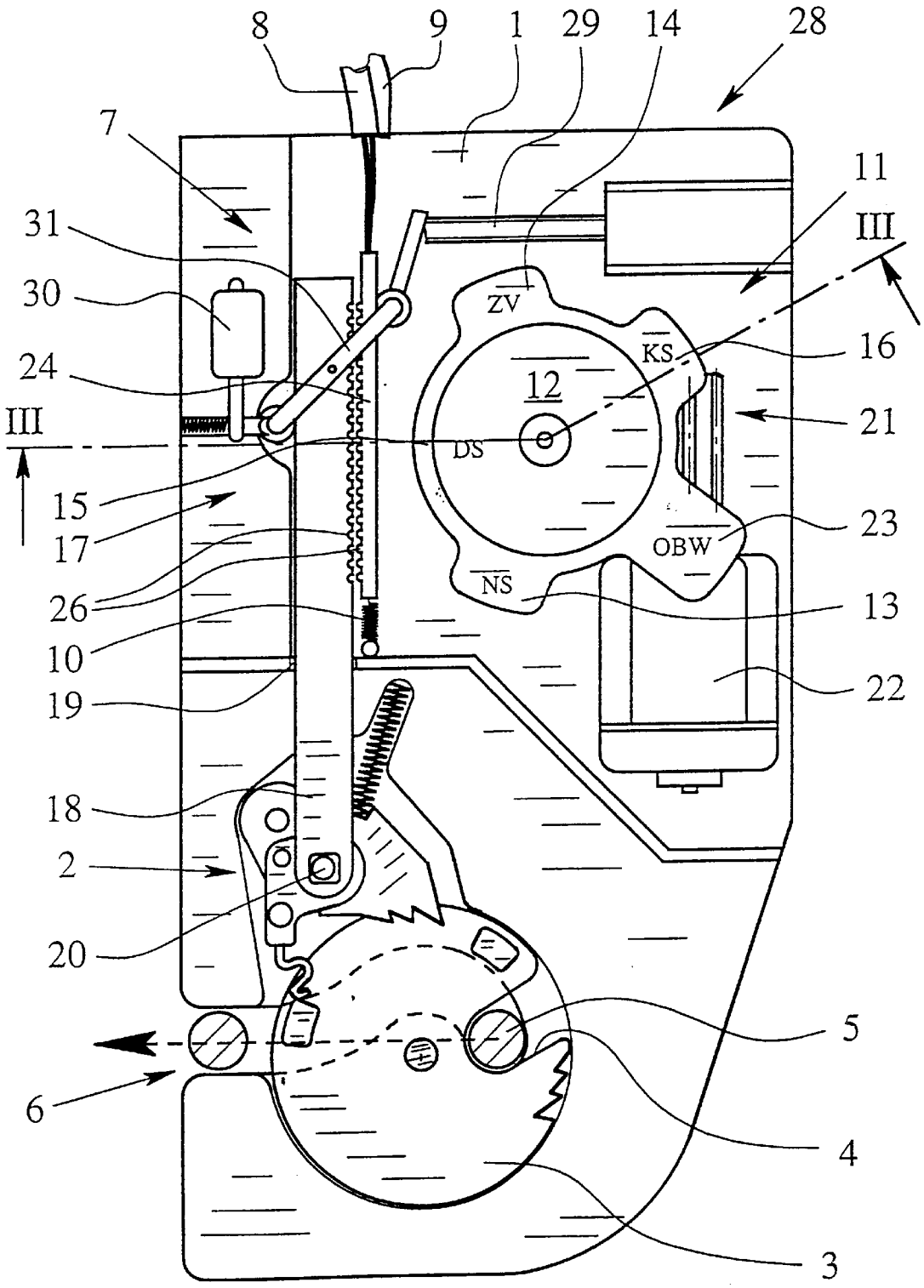
FIG. 1 is a schematic elevational view of one embodiment of a motor vehicle door lock in accordance with the present invention with the housing opened and the control disk of the controller in the "theft-proof" operating position.

FIG. 1 shows a motor vehicle door lock for the side door of a motor vehicle in accordance with the present invention. Although in the following, the present invention is described using the example of a motor vehicle side door lock, the present invention can also be applied to other locks including hood locks, gate locks and tailgate locks on motor vehicles which in the present application, may be understood to be door locks. In this regard, these other applications should be considered to be within the teachings of this patent application.

FIG. 1 shows a motor vehicle door lock in accordance with the present invention with housing 1 opened so that the various components of the door lock may be clearly seen. Housing 1 includes a detent pawl 2 which, in the preferred embodiment shown, is made as a two-part detent pawl. In a locked position, the detent pawl 2 fixes lock catch 3 which, in the embodiment shown, is made as a rotary catch with a receiving opening 4 which encompasses a leading bridge 5 of a key collar 6 which may be made as a clip. The subject matter of the present invention is directed toward the motor vehicle door lock and its control, thus the construction of detent pawl 2 and lock catch 3 in particular are not significant in the present application.

As shown in FIG. 1, a dynamic actuation linkage 7 extends from an outside door handle via outside pull 8, and also from an inside door handle via inside pull 9, to the detent pawl 2. This dynamic actuation linkage 7 allows the transference of force and movement from the door handles to operate the detent pawl 2 such that the motor vehicle door may be opened. Furthermore, the dynamic actuation linkage 7 may selectively be made engaged or disengaged in accordance with the desired function of the motor vehicle door such that, when the dynamic actuation linkage 7 is engaged, the transference of force and movement to the detent pawl 2 is allowed, but when the dynamic actuation linkage is disengaged, the transference of force and movement to the detent pawl 2 is interrupted. Although the inside and outside door handles are not shown, pulls 8, 9 are illustrated which transfer forces exerted on the door handles to the door lock of the present invention. In addition, although the pulls 8, 9 are illustrated as Bowden cables, other force transferring means may also be used including linkages, different types of cables, actuators, etc. in practicing the present invention. In the illustrated embodiment, a spring element 10 is provided for keeping the pulls 8, 9 in the desired position. Thus, the detent pawl 2 which operates the lock catch 3 that opens the motor vehicle door can be actuated through the dynamic actuation linkage 7.

A controller which is generally identified by arrow 11 is shown integrated in the housing 1 of the motor vehicle door lock thereby providing an integrated central locking drive in the embodiment shown. However, the controller 11 may also be provided with and located within its own housing separate from housing 1. The controller 11 allows the motor vehicle door lock to have various functional positions including a "locked" position and an "unlocked" position. In the preferred embodiment shown, the controller 11 also allows the motor vehicle door lock to have other functional positions including a "theft-proof" position and a "child-proof" position. In the embodiment shown in FIG. 1, controller 11 is in the "theft-proof" position, identified as "DS".

The controller 11 controls the dynamic actuation linkage 7 such that, when in the "locked" position, the dynamic actuation linkage 7 is disengaged with respect to the outside door handle, ie. the outside pull 8, but the dynamic actuation linkage 7 is engaged with respect to the inside door handle, ie. the inner pull 9. In this "locked" position, the motor vehicle door lock functions such that the door cannot be opened from the outside by using the outside door handle, but an individual sitting inside can open the motor vehicle door by using the inside door handle.

In the "unlocked" position, the dynamic actuation linkage 7 is engaged with respect to both the outside door handle and the inside handle such that the motor vehicle door can be opened by both outside and inside door handles.

In the "theft-proof" position, the dynamic actuation linkage is disengaged to both the outside door handle and the inside handle so that actuation of either handles does not operate the detent pawl 2 and the lock catch 3 remains in a locked position such that the motor vehicle door remains closed.

Finally, in the "child-proof" position, the dynamic actuation linkage 7 to the outside door handle is engaged so that the motor vehicle door can be opened by the outside door handle but the dynamic actuation linkage 7 to the inside door handle is disengaged so that the motor vehicle door cannot be opened by the inside door handle by a person inside, such as a child.

The embodiment of the present invention in FIG. 1 shows that the controller 11 includes a control disk 12 which allows the above explained functions in the respective positions as will be discussed herein below.

As clearly shown in FIG. 1, the control disk 12 includes a plurality of peripherally located control cams 13, 14, 15, 16, each corresponding to the various functional positions noted above. More specifically, the control cam 13 corresponds to the normal, "unlocked" position and is indicated by NS. The control cam 14 corresponds to the "locked" position and is indicated by ZV. The control cam 15 corresponds to the "theft-proof" position and is indicated by DS. It should be noted that the control cam 15 ofthe "theft-proof"

position is not a physical projection as are the other cams in the present embodiment, but is formed by the indicated edge area of control disk 12. The control cam 16 which corresponds to the "child-proof" position is indicated by KS. The positioning of the controller 11 positions one of the various control cams such that the control cam interacts within a control segment 17 of the dynamic actuation linkage 7 to make the dynamic actuation linkage 7 either engaged or disengaged with respect to the inside door handles and the outside door handles thereby enabling the motor vehicle door lock to function in accordance with one of the functional positions discussed above.

FIG. 1 illustrates the controller 11 positioned in the "theft-proof" position where the control cam 15 makes the dynamic actuation linkage 7 disengaged such that force and movement cannot be transferred and applied to the detent pawl 2 through the control segment 17 or either the outside pull 8 or the inside pull 9. In the other functional positions, this force and movement can be used to trigger element 18 on detent pawl 2, which is made in the conventional manner such as a lever in the present embodiment. The trigger element 18 may be guided by a guide 19 and may be coupled to the detent pawl 2 by a driving lug 20. Of course, this specific details of how the control segment 17 is joined to the detent pawl 2 in the embodiment discussed is only one of many embodiments of the present invention and may be modified by one skilled in the art to join the control segment 17 to detent pawl 2 in a different manner.

It is important to recognize that by rotating the control disk 12 shown in the present embodiment, one ofthe control cams 13, 14, 15, 16 are positioned specifically within the control segment 17 such that the motor vehicle door lock functions in the manner corresponding to the functional positions discussed above. Thus, the area in which the dynamic actuation linkage 7 is controlled to be engaged or disengaged is thereby confined to control segment 17 in the present embodiment. Correspondingly, the dynamic actuation linkage 7 can be made structurally simple, and the plurality of levers which were positioned in an arc around control disk 12 in the designs can be eliminated. Furthermore, in practicing the present invention, it has been found that the costs associated with engineering and controlling the control disk 12 in the controller 11 is not any greater than complex designs used in the prior art.

Of course, the teaching of the present invention is not limited to the control disk 12 of controller 11 which is driven by motor in the present embodiment. Rather, the present invention may also be applied with control disk 12 which may be coupled to a mechanical or a manual actuating means such as a closing cylinder or an actuating button. In this manner, the control disk 12 may be moved into the respective functional position by a mechanically or manually actuated controller 11.

The present invention in accordance to the preferred embodiment includes a controller with an electric drive motor 22 which is coupled to control disk 12 through a mechanical linkage such as a worm-wheel pair which is commonly known in the art. The electric drive motor 22 shown is a low power motor which can be driven in two directions of rotation. It can be controlled in the conventional manner by contacts, proximity switches or sliding switches, such that the control disk 12 always assumes the desired position. A different type of motor, for example a pneumatic drive, can also be used as a drive motor 22.

The preferred embodiment of the control disk 12 in accordance with the present invention as illustrated in FIG. 1 also includes a drive cam 23 in addition to control cams 13, 14, 15, 16. The drive cam 23 provides a motorized opening function (open by wire, OBW) and operates within the control segment 17 of the dynamic linkage path 7 to operate the detent pawl 2. This feature is better illustrated in FIG. 2 which shows the position of control disk 12 for the motorized opening function. Further rotation of control disk 12 in the direction shown by the arched arrow causes the drive cam 23 push upward on a stop 27 that is located on the trigger element 18 so that detent pawl 2 is lifted and the lock catch 3 is operatively turned counterclockwise thereby opening the vehicle door. Thus, the drive motor 22 is which may be provided in the motor vehicle door lock without additional costs, not only provides as a central locking drive, but also provides a door opening feature. As an example only, the outside pull 8 of the outside door handle can theoretically be omitted since this embodiment of the motor vehicle door lock can be opened from the outside by an electrical switching command.

Figure 2:
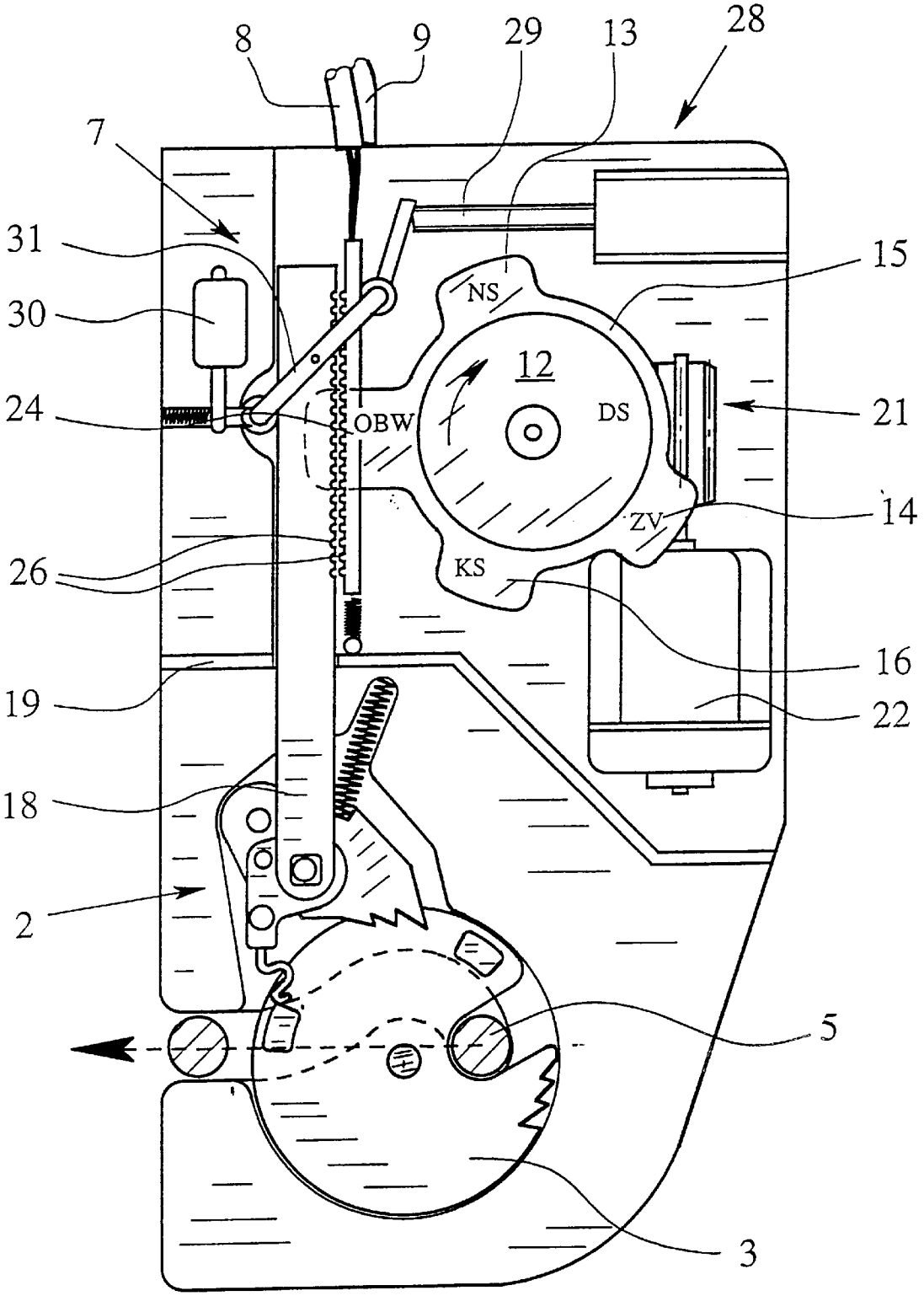
FIG. 2 is a schematic elevational view of the motor vehicle door lock corresponding to that of FIG. 1, but with the control disk in the "motorized opening" position.
Figure 3:
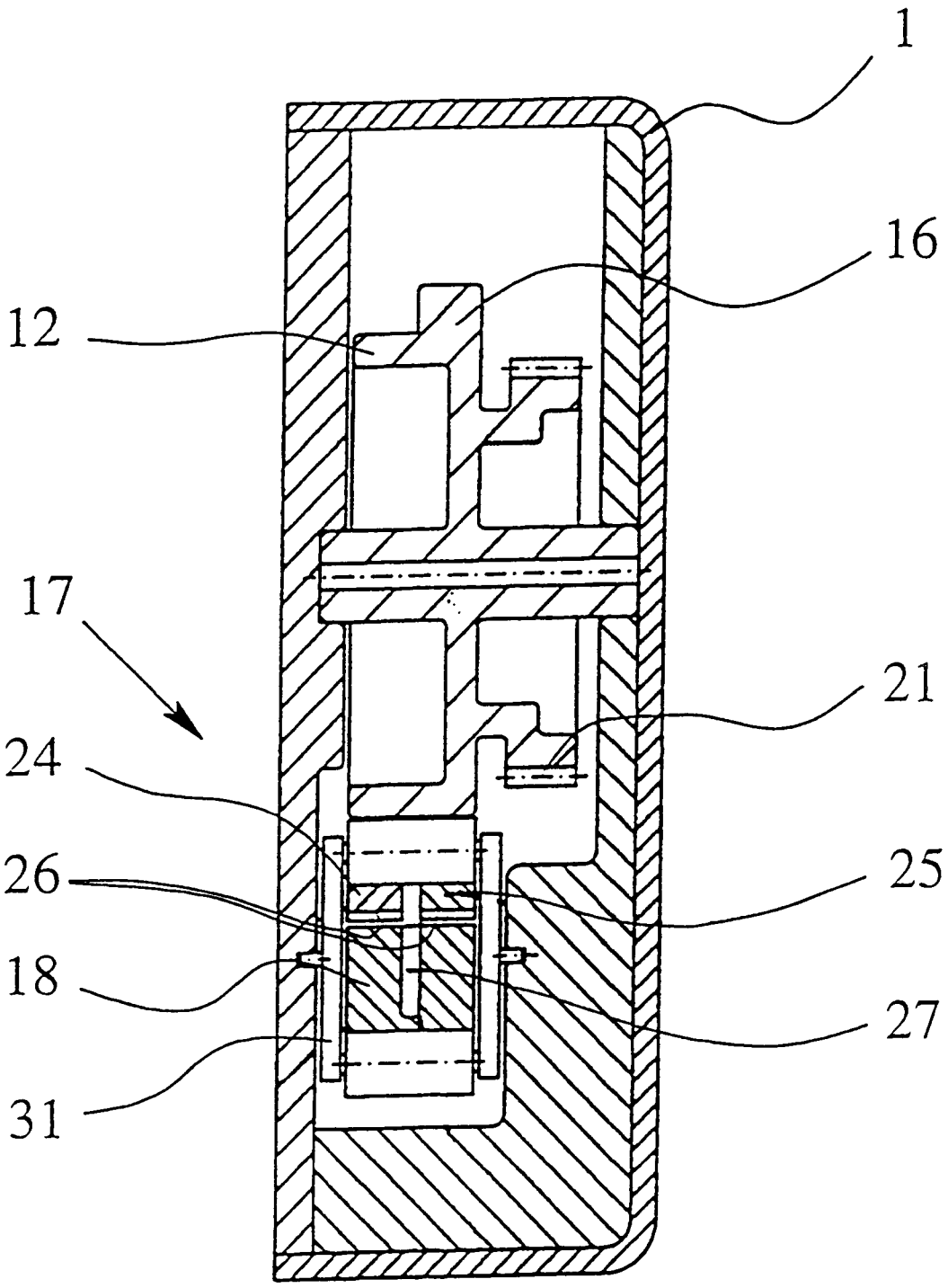
FIG. 3 is a schematic elevational view of the motor vehicle door lock as viewed along line III—III of FIG. 1.

FIG. 3 which illustrates a cross-sectional view of the motor vehicle door lock shown in FIGS. 1 and 2 is discussed in more detail below. As illustrated in these drawings, the control cams are arranged on the control disk 12 such that control cams 13, 14, 15, 16, and drive cam 23 also present here, are arranged in different axial planes of control disk 12 and interact with components located in control segment 17 at different planes in the dynamic actuation linkage 7. This is especially clearly illustrated in FIG. 3 with respect to control disk 12. The arrangement of control cams 13, 14, 15, 16 in different planes makes the direction of rotation of control disk 12 noncritical to the proper functioning of the motor vehicle door lock. However, with respect to drive cam 23, the direction of rotation of control disk 12 is important since the lifting of the detent pawl 2 requires a certain direction of motion by trigger element 18.

According to the illustrated preferred embodiment, a simple configuration of control segment 17 in the dynamic actuation linkage 7 is provided which will effectively allow the motor vehicle door to be used in the various functional positions noted previously. In this preferred embodiment, the detent pawl 2 is connected to trigger element 18 which extends into the control segment 17. A first actuating elements 24 and a second actuating element 25 extend into the control segment 17 and are connected to the outside door handle and the inside door handle, respectively. In the various functional positions discussed above, the respective actuating element 24 and/or 25 is engaged with the trigger element 18 such that the dynamic actuation linkage 7 is engaged with respect to the outer door handle and/or inner door handle in accordance with the functional position. Also in this embodiment, the actuating motion for detent pawl 2 is a displacement motion in the lengthwise direction of the control segment 17 within the dynamic actuation linkage 7. The actuating elements 24 and 25 may be engaged together with the trigger element 18 thereby making the dynamic actuation linkage 7 engaged. A guide 19 on housing 1 is provided to guide the displacement motion of trigger element 18. In FIGS. 1 and 2, the second actuating element 25 ofthe inside door handle which is connected to the inside pull 9, is hidden below the first actuating element 24 of the outside door handle which is connected to the outside pull 8, and thus, the actuating element 25 is located underneath in the plane of the drawing. FIG. 3 more clearly shows the two actuating elements 24 and 25.

The specific design of the engagement of actuating elements 24 and 25 on the one hand, and the trigger element 18 on the other is of special importance. As illustrated in FIGS.

1 and 2, the actuating elements 24 and 25 are pretensioned into the desired position by the outside pull 8 and/or inside pull 9 and a spring element 10 or two spring elements (not shown) such that actuating elements 24 and 25 do not engage the trigger element 18. The control disk 12 with control cams 13, 14, 15, 16, each corresponding to the different functional positions work against this spring force.

In this embodiment, the trigger element 18 and actuating elements 24 and 25 may be made as rods or strips with rows of teeth 26 facing one another such that, normally, the rows of teeth 26 are disengaged from one another and can be engaged with one another by the control disk 12 against the reset force. This design is very simple, reliable and for the most part, free of wear. This design provides a simple way of localizing the control segment 17 within the dynamic actuation linkage 7 such that the motor vehicle door lock may be effectively controlled. This design also allows a motor vehicle door lock to achieve the various functional positions without complex designs and also allows the dynamic actuation linkage path 7 to be disengaged with respect to both pulls 8 and 9 so that operation of the door handles do not open the motor vehicle door. In addition, the motorized opening function can be easily integrated into this control means 11 with control segment 17 configured in this manner. For example, the drive cam 23 can enter between the two rows of teeth 26 of the actuating elements 24 and 25, as illustrated in FIG. 2, causing the drive cam 23 to push upward on a stop (not shown) located on the trigger element 18 so that detent pawl 2 is lifted and the lock catch 3 is operatively turned counterclockwise thereby opening the vehicle door.

The actuating elements 24 and 25 are provided with rows 26 of teeth in the same way as trigger element 18 in this embodiment and all these elements can be made of plastic. The forces exerted during use is not so large that these components would have to be made of metal. One advantage of using metal however is that it will continue to be operative in case of a fire. In this embodiment, the plastic elements 18, 24 and 25 may be provided with metal inserts (not shown). In another embodiment, the metal insert of one of the elements 18, 24 and 25, especially of trigger element 18, may be made with a prestressed adjustment spring, the metal inserts themselves having rows ofteeth so that when the plastic melts away during a fire, the adjustment spring causes the rows of teeth to engage each other.

In addition, the motor vehicle door lock or the like in accordance with the present invention and illustrated in the figures can include additional features such that the motor vehicle door lock or the like may be opened from the outside even in the event of a crash. If there is only one electric motor drive in the control means 11, the motor drive can be supplied through an emergency battery when the central electrical system ofthe motor vehicle fails. In the illustrated embodiment of the present invention, however, there is separate emergency trigger means 28 which is dedicated to the control segment 17 of the dynamic actuation linkage 7 which, in cases of emergency, moves the dynamic actuation linkage path 7 into the "unlocked" function position so that the motor vehicle door may be opened from both the outside door handle and the inside door handle.

In the embodiment shown in FIG. 1, the motor vehicle door lock is provided with an emergency trigger 28 including a thrustor 29 which can be actuated by a closing cylinder or other actuating means, for example, an inside handle. Therefore, if the motor vehicle electrical system fails, the emergency trigger 28 on the vehicle door can be moved into the "unlocked" functional position.

Furthermore, in the embodiment shown, the emergency trigger 28 may also include a crash switch 30 which triggers when the acceleration forces exceeds the force levels which occur during normal operations. This crash switch 30 in the embodiment shown in FIG. 1 may be provided with a rocker 31 which immediately engages the rows 26 of teeth of the elements 18, 24, 25 in the event of a crash such that the motor vehicle door lock is instantly placed in the "unlocked" functional position. Of course, in this embodiment, design parameters must be considered carefully such that the normal acceleration forces present when the vehicle door is slammed will not cause the triggering of the crash switch 30. In an alternative embodiment, the rocker 31 in FIGS. 1 and 2 is coupled to swivel on housing 1 as illustrated in FIG. 3, and is actuated both by crash switch 30 and also by thrustor 29.

We claim:

1. Motor vehicle door lock comprising a housing with a detent pawl including a lock catch, a dynamic actuation linkage extending from an outside door handle and an inside door handle to said detent pawl and with which said detent pawl is actuatable to trigger said lock catch to unlock a motor vehicle door, and a control means including a control disk with a plurality of peripherally located control cams, each of said plurality of control cams corresponding to a respective one of plurality of functional positions including at least a locked position and an unlocked position, wherein said control means is provided with a means for enabling selective displacement of the control means into a plurality of positions, in each of which a respective one of said plurality of control cams individually interacts with a control segment of said dynamic actuation linkage in a manner that, in said locked position, said dynamic actuation linkage is disengaged relative to said outside door handle as a means for preventing said motor vehicle door from being opened by said outside door handle but said dynamic actuation linkage is engaged relative to said inside door handle as a means for enabling said motor vehicle door to be opened by said inside door handle, and in the unlocked position, said dynamic actuation linkage is engaged relative to both said outside door handle and said inside door handle as a means for enabling said motor vehicle door to be opened by both said outside door handle and said inside door handle.

2. Motor vehicle door lock as claimed in claim 1, wherein said plurality of functional positions further include a "theft-proof" position in which said dynamic actuation linkage is disengaged relative to both said outside door handle and said inside door handle so that said motor vehicle door cannot be opened by either of said outside door handle and said inside door handle.

3. Motor vehicle door lock as claimed in claim 1, wherein said plurality of functional positions further include a "child-proof" position in which said dynamic actuation linkage is disengaged relative to said inside door handle so that said motor vehicle door cannot be opened by said inside door handle but said dynamic actuation linkage is engaged relative to said outside door handle so that said motor vehicle door can be opened by said outside door handle.

4. Motor vehicle door lock as claimed in claim 1, wherein said control disk is coupled to a mechanical actuating means.

5. Motor vehicle door lock as claimed in claim 4, wherein said mechanical actuating means is coupled to an electrical drive motor.

6. Motor vehicle door lock as claimed in claim 1, wherein said control disk further includes a drive cam which interacts with said control segment of said dynamic actuation linkage so as to lift said detent pawl and thereby provide a motorized opening function.

7. Motor vehicle door lock as claimed in claim 6, wherein said control cams and said drive cam are arranged on said control disk in different axial planes corresponding to different planes in which a pair of actuating elements of said control segment of said dynamic actuation linkage are located so as to engage one or both of said actuating elements.

8. Motor vehicle door lock as claimed in claim 1, wherein said detent pawl is connected to a trigger element which extends into said control segment; wherein a first actuating element of said control segment is connected to the outside door handle and a second actuating element of said control segment is connected to the inside door handle; and wherein said continuous dynamic actuation linkage is engaged with the door handles by engagement of the actuating elements with said trigger element.

9. Motor vehicle door lock as claimed in claim 8, wherein said detent pawl is actuated by a displacement motion in a lengthwise direction of said trigger element; and of said control segment wherein said first and second actuating elements and said trigger element are caused to be engaged with one another by a motion of said first and second actuating elements transversely to the lengthwise direction.

10. Motor vehicle door lock as claimed in claim 8, wherein said trigger element and said first and second actuating elements are made as rods provided with rows of teeth facing one another which are normally disengaged from one another and which are engaged with one another by the cams of said control disk against a reset force.

11. Motor vehicle door lock as claimed in claim 10, wherein said trigger element further includes a stop for a drive cam.

12. Motor vehicle door lock as claimed in claim 11, wherein said stop is provided between said rows of teeth on said trigger element.

13. Motor vehicle door lock as claimed in claim 8, wherein at least one of said trigger element, said first actuating element and said second actuating element is made of plastic.

14. Motor vehicle door lock as claimed in claim 8, wherein at least one of said trigger element, said first actuating element and said second actuating element is made of metal.

15. Motor vehicle door lock as claimed in claim 8, wherein said control segment includes an emergency trigger means which, in case of an emergency, operates to engage said dynamic actuation linkage such that said motor vehicle door lock operates as in the unlocked functional position.

16. Motor vehicle door lock as claimed in claim 15, wherein said emergency trigger means includes a thrustor which is actuatable by an actuating means.

17. Motor vehicle door lock as claimed in claim 15, wherein said emergency trigger means further comprises an acceleration responsive crash switch which is triggered when acceleration forces exceeding a predetermined level one experienced.

18. Motor vehicle door lock claimed in claim 15, wherein said emergency trigger means comprises an actuating element rocker which causes said rows of teeth on said trigger means to engage a row of teeth on each of said first and second actuating elements.

* * * * *